US009387968B2

(12) United States Patent
Zammit et al.

(10) Patent No.: US 9,387,968 B2
(45) Date of Patent: Jul. 12, 2016

(54) CARTON WITH RETENTION FEATURES

(71) Applicant: Graphic Packaging International, Inc., Atlanta, GA (US)

(72) Inventors: Mark Zammit, Douglasville, GA (US); Robert L. Sutherland, Kennesaw, GA (US); Kevin T. May, Kennesaw, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/623,829

(22) Filed: Feb. 17, 2015

(65) Prior Publication Data

US 2015/0239628 A1 Aug. 27, 2015

Related U.S. Application Data

(60) Provisional application No. 61/966,355, filed on Feb. 21, 2014.

(51) Int. Cl.
*B65D 71/20* (2006.01)
*B65D 5/44* (2006.01)
(Continued)

(52) U.S. Cl.
CPC ..... *B65D 71/20* (2013.01); *B65D 5/443* (2013.01); *B65D 5/5002* (2013.01); *B65D 71/18* (2013.01); *B65D 71/32* (2013.01); *B65D 71/34* (2013.01); *B65B 5/024* (2013.01)

(58) Field of Classification Search
CPC ..... B65D 71/20; B65D 71/32; B65D 71/34; B65D 5/443; B65B 5/024
USPC ..... 206/434, 427; 229/103.2, 117.14, 185, 229/122
See application file for complete search history.

(56) References Cited

U.S. PATENT DOCUMENTS 3,229,892 A * 1/1966 Weiss ..... B65D 71/20 206/152
5,524,756 A * 6/1996 Sutherland ..... B65D 71/16 206/140

(Continued)

FOREIGN PATENT DOCUMENTS

JP 11-278426 A 10/1999
JP 2005-350105 A 12/2005

(Continued)

OTHER PUBLICATIONS

International Search Report and Written Opinion for PCT/US2015/016089 dated May 21, 2015.

*Primary Examiner* — Steven A. Reynolds
(74) *Attorney, Agent, or Firm* — Womble Carlyle Sandridge & Rice, LLP

(57) ABSTRACT

A carrier for holding a plurality of articles. The carrier includes a plurality of panels including at least a bottom panel. A retention tab can be for engaging at least a portion of an article of the plurality of articles and can be foldably connected to at least the bottom panel adjacent an opening in at least the bottom panel. The retention tab can include a distal portion foldably connected to a first proximal portion along a first fold line and to a second proximal portion along a second fold line. The first fold line can be spaced apart from the second fold line. The distal portion can be generally spaced apart from the bottom panel for engaging at least a bottom portion of the at least one article, and each of the first and second proximal portions can extend from the bottom panel to the distal portion.

36 Claims, 16 Drawing Sheets

(51) Int. Cl.

| | |
|---|---|
| ***B65D 5/50*** | (2006.01) |
| ***B65D 71/32*** | (2006.01) |
| ***B65D 71/34*** | (2006.01) |
| ***B65D 71/18*** | (2006.01) |
| *B65B 5/02* | (2006.01) |

(56) References Cited

U.S. PATENT DOCUMENTS

| | | | | |
|---|---|---|---|---|
| 5,605,228 | A * | 2/1997 | Baxter | B65D 71/16 206/140 |
| 5,941,389 | A * | 8/1999 | Gomes | B65D 71/20 206/427 |
| 6,378,697 | B1 * | 4/2002 | Sutherland | B65D 71/16 206/140 |
| 6,988,617 | B2 * | 1/2006 | Gomes | B65D 71/14 206/434 |
| 2005/0199514 | A1 * | 9/2005 | Sutherland | B65D 71/20 206/170 |
| 2012/0267426 | A1 | 10/2012 | Hendricks et al. | |
| 2012/0285855 | A1 * | 11/2012 | Spivey, Sr. | B65D 71/18 206/434 |

FOREIGN PATENT DOCUMENTS

| | | | |
|---|---|---|---|
| JP | 2009-120248 | A | 6/2009 |
| WO | WO 98/50284 | | 11/1998 |
| WO | WO 2005/123533 | A1 | 12/2005 |

* cited by examiner

CARTON WITH RETENTION FEATURES

CROSS-REFERENCE TO RELATED APPLICATION

This application claims the benefit of U.S. Provisional Patent Application No. 61/966,355, filed Feb. 21, 2014.

INCORPORATION BY REFERENCE

The disclosures of U.S. Provisional Patent Application No. 61/966,355, which was filed on Feb. 21, 2014, and U.S. Pat. No. 6,988,617, which was issued Jan. 24, 2006, are hereby incorporated by reference for all purposes as if presented herein in their entirety.

BACKGROUND OF THE DISCLOSURE

The present disclosure generally relates to cartons or carriers for holding and dispensing beverage containers or other types of articles.

SUMMARY OF THE DISCLOSURE

In general, one aspect of the disclosure is directed to a carrier for holding a plurality of articles. The carrier comprises a plurality of panels at least partially extending around an interior of the carrier. The plurality of panels can comprise at least a bottom panel. A retention tab can be for engaging at least a portion of an article of the plurality of articles. The retention tab can be foldably connected to at least the bottom panel adjacent an opening in at least the bottom panel. The retention tab can comprise a distal portion foldably connected to a first proximal portion along a first fold line and to a second proximal portion along a second fold line. The first fold line can be spaced apart from the second fold line. The distal portion can be generally spaced apart from the bottom panel for engaging at least a bottom portion of at least one article of the plurality of articles, and each of the first proximal portion and the second proximal portion can extend from the bottom panel to the distal portion.

In another aspect, the disclosure is generally directed to a blank for forming a carrier for holding a plurality of articles. The blank comprises a plurality of panels comprising at least a bottom panel and a retention tab for engaging at least a portion of an article of the plurality of articles when the carrier is formed from the blank. The retention tab can be foldably connected to at least the bottom panel and can be at least partially separable from the bottom panel along at least one cut. The retention tab can comprise a distal portion foldably connected to a first proximal portion along a first fold line and to a second proximal portion along a second fold line. The first fold line can be spaced apart from the second fold line. Each of the first proximal portion and the second proximal portion can be foldably connected to the bottom panel, and the distal portion can be for being generally spaced apart from the bottom panel for engaging a bottom portion of at least one article of the plurality of articles when the carrier is formed from the blank.

In another aspect, the disclosure is directed to a method of forming a carrier for holding a plurality of articles. The method comprises obtaining a blank comprising a plurality of panels comprising at least a bottom panel, and a retention tab foldably connected to at least the bottom panel and being at least partially separable from the bottom panel along at least one cut line. The retention tab can comprise a distal portion foldably connected to a first proximal portion along a first fold line and to a second proximal portion along a second fold line. The first fold line can be spaced apart from the second fold line. The method also can comprise forming at least a portion of an interior of the carton by folding the plurality of panels relative to one another, and positioning the retention tab for engaging at least a bottom portion of at least one article of the plurality of articles. The positioning the retention tab can comprise positioning the distal portion of the retention tab to be generally spaced apart from the bottom panel so that each of the first proximal portion and the second proximal portion extends from the bottom panel to the distal portion and so that the retention tab is foldably connected to at least the bottom panel adjacent an opening at least in the bottom panel.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans) as disposed within the carrier embodiments. In this specification, the terms "inner," "interior," "outer," "exterior," "lower," "bottom," "upper," and "top" indicate orientations determined in relation to fully erected and upright cartons.

Figure 1:
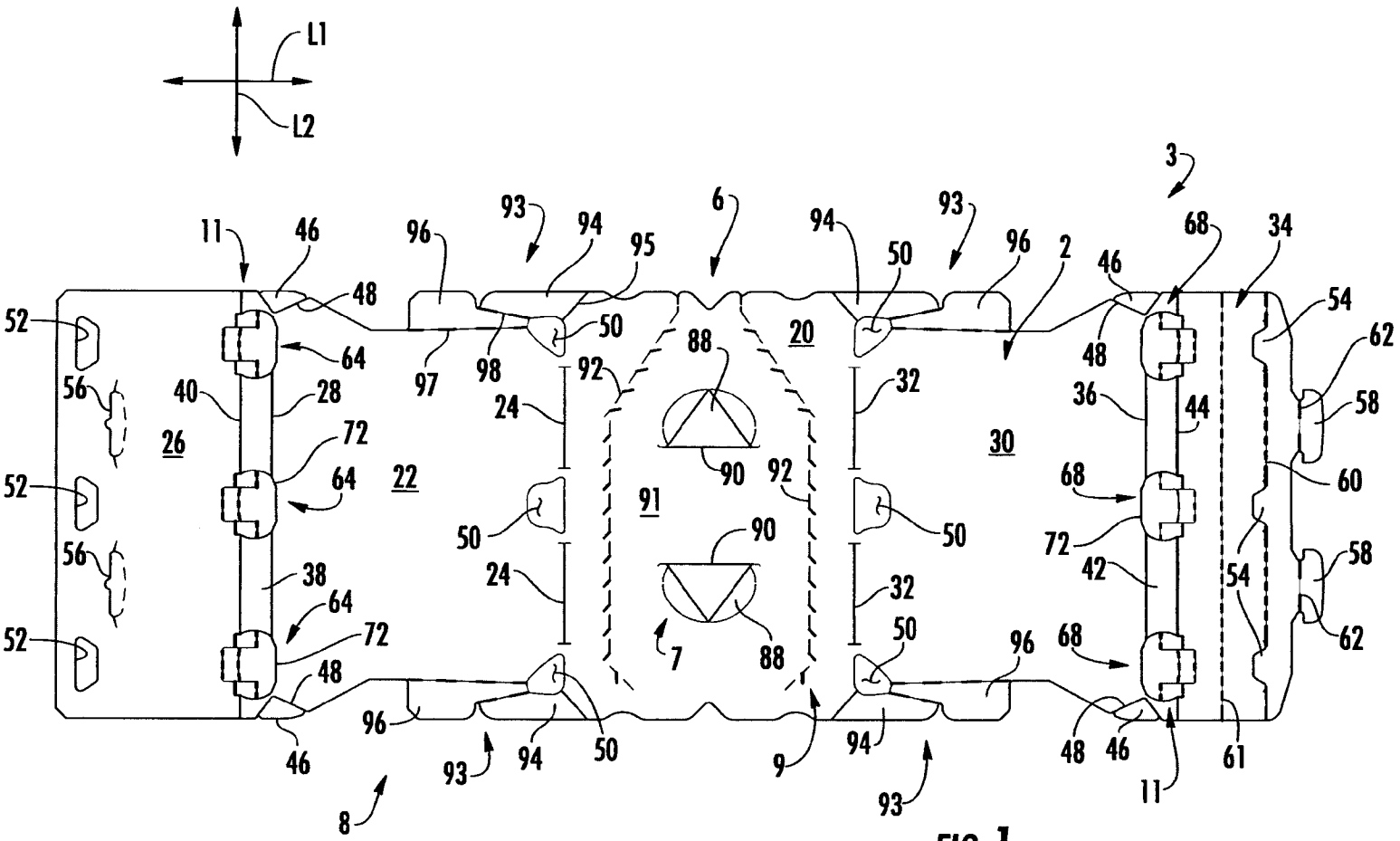
FIG. 1 is a plan view of an exterior surface of a blank used to form a carrier according to a first exemplary embodiment of the disclosure.

FIG. 1 is a plan view of an exterior surface 2 of a blank 3, used to form a carton or carrier 5 (FIGS. 4-7) according to a first embodiment of the disclosure. The carrier 5 can be used to house a plurality of articles such as containers C (FIGS. 3-6). In the illustrated embodiment, the containers C are beverage cans and the carrier 5 is sized to house six containers in a single layer in a 2×3 arrangement, but it is understood that the carrier 5 may be sized and shaped to hold containers C of a different or same quantity in more than one layer and/or in different row/column arrangements (e.g., 1×6, 2×6, 2×4, 2×2, 2×6×2, 2×4×2, 2×9, etc.). In the illustrated embodiment, the carrier 5 can include bottom retention features 11 for engaging the bottom portions B of the containers C. In addition, the carrier 5 can include a handle, generally indicated at 7, for grasping and carrying the carrier. The carrier 5 can also include a dispenser 9 for accessing the container C in the carrier.

In the illustrated embodiment, the carrier 5 is a carrier that has generally open ends 6, 8 and that wraps around the containers C (e.g., the carrier 5 may be referred to as a wrap-around carton). The carrier 5 could be otherwise shaped and arranged such that the ends 6, 8 are at least partially closed such as by end flaps (not shown) or other closing mechanisms.

The blank 3 has a longitudinal axis L1 and a lateral axis L2. In the illustrated embodiment, the blank 3 comprises a top panel 20 foldably connected to a first side panel 22 at a first lateral fold line 24, a first bottom panel 26 foldably connected to the first side panel 22 at a second lateral fold line 28, a second side panel 30 foldably connected to the top panel 20 at a third lateral fold line 32, and a second bottom panel 34 foldably connected to the second side panel 30 at a fourth lateral fold line 36. In the illustrated embodiment, the first bottom panel 26 includes a first bottom bevel panel 38 defined by lateral fold lines 28 and 40. The second bottom panel 34 includes a second bottom bevel panel 42 defined by lateral fold lines 36 and 44. Bottom corner flaps 46 can be foldably connected to each of the side panels 22, 30 along respective fold lines 48 adjacent the respective bottom panels 26, 34. In one embodiment, the fold lines 48 can be V-shaped. Additionally, the first lateral fold line 24 and the third lateral fold line 32 can include two segments each, wherein a lateral cut is disposed at each end of each segment. An upper opening 50 can be disposed between the segments of the first lateral fold line 24, between the segments of the third lateral fold line 32, and at each end of the lateral fold lines 24, 32 for receiving at least a portion of a top portion T of a respective container C.

The first bottom panel 26 includes cutouts forming primary female locking edges 52 that are shaped and positioned to engage primary male locking tab projections 54 on the second bottom panel 34. The first bottom panel 26 also includes slits 56 shaped and positioned to receive outer secondary locking tab projections 58 of the second bottom panel 34. As shown in FIG. 1, a locking flap can be foldably connected to the first bottom panel 26 adjacent the slits 56. In the illustrated embodiment, the second bottom panel 34 includes lateral fold lines 60, 61. The lateral fold lines 60 can be interrupted by the slits that define the primary male locking tab projections 54. In addition, each of the secondary locking tab projections 58 can include a lateral fold line 62. Although the locking elements of the blank 3 are illustrated to demonstrate a particular bottom panel locking arrangement suitable for use with the carrier 5, it is understood that any alternative form of bottom panel locking structure may be employed without departing from the disclosure.

Figure 2B:
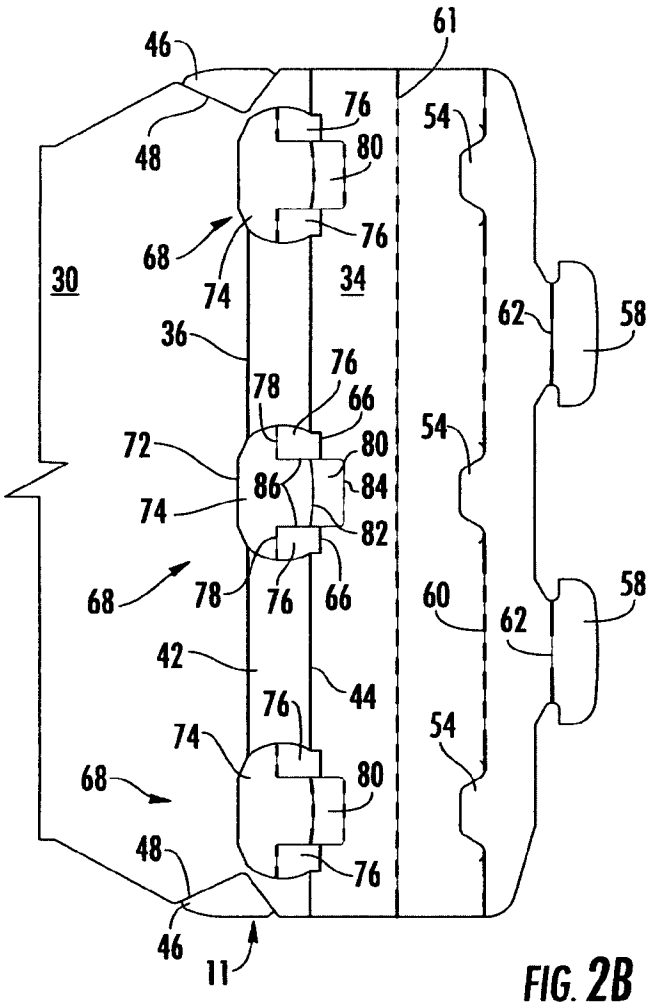
FIGS. 2A and 2B are views of respective bottom panels and retention features of the blank of FIG. 1.
Figure 2A:
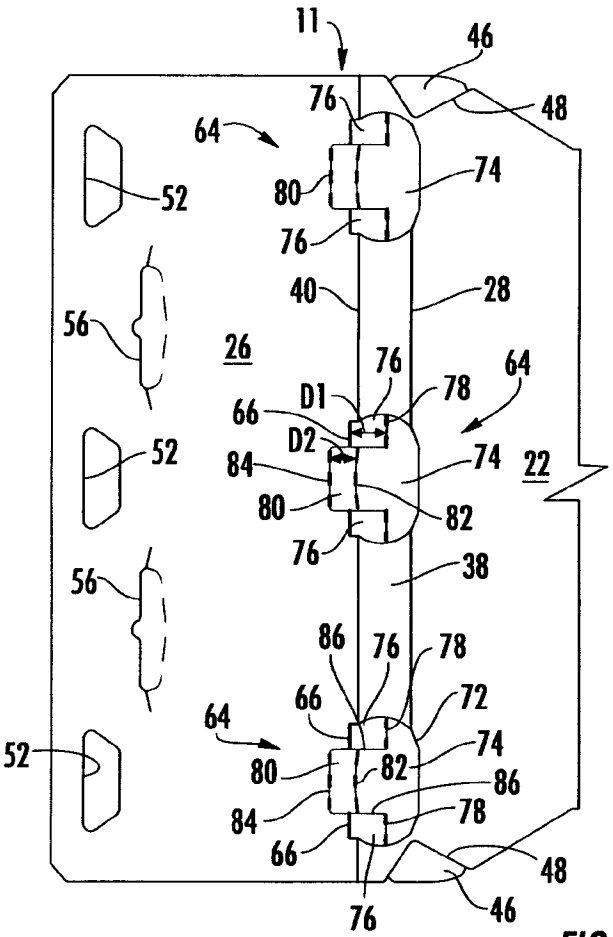

As shown in FIGS. 1, 2A, and 2B, the bottom retention features 11 can include first retention tabs 64 each foldably connected to the first bottom panel 26 and second retention tabs 68 each foldably connected to the second bottom panel 34. Each of the first and second retention tabs 64, 68 can be further defined by respective cut lines 72, which can be generally U shaped. In the illustrated embodiment, each of the first and second retention tabs 64, 68 includes a distal portion 74 foldably connected to two proximal portions 76 (e.g., first proximal portions) along respective lateral fold lines 78. The proximal portions 76 can be foldably connected to the respective bottom panel 26, 34 along respective lateral fold lines 66. In one embodiment, the lateral fold lines 78 are generally aligned with one another (e.g., generally collinear with one another), and the lateral fold lines 66 are generally aligned with one another (e.g., generally collinear with one another).

In each retention tab 64, 68, the distal portion 74 can be foldably connected to an offset proximal portion 80 (e.g., second proximal portion) along an offset fold line 82, and the offset proximal portion 80 can be foldably connected to the respective bottom panel 26, 34 along a respective offset fold line 84. In the illustrated embodiment, the offset fold lines 82, 84 are offset from the lateral fold lines 66, 78, the offset fold line 82 is slightly curved with a radius of curvature directed away from the top panel 20, and the offset fold line 84 generally extends in the lateral direction L2. In one embodiment, the distance D1 (FIG. 2A) between each lateral fold line 78 and the respective lateral fold line 66 is greater than the distance D2 (FIG. 2A) between each offset fold line 82 and the respective offset fold line 84. The offset portion 80 and the distal portion 74 are separable from the first bottom panel 26 and from the proximal portions 76 along cut lines 86.

Figure 3:
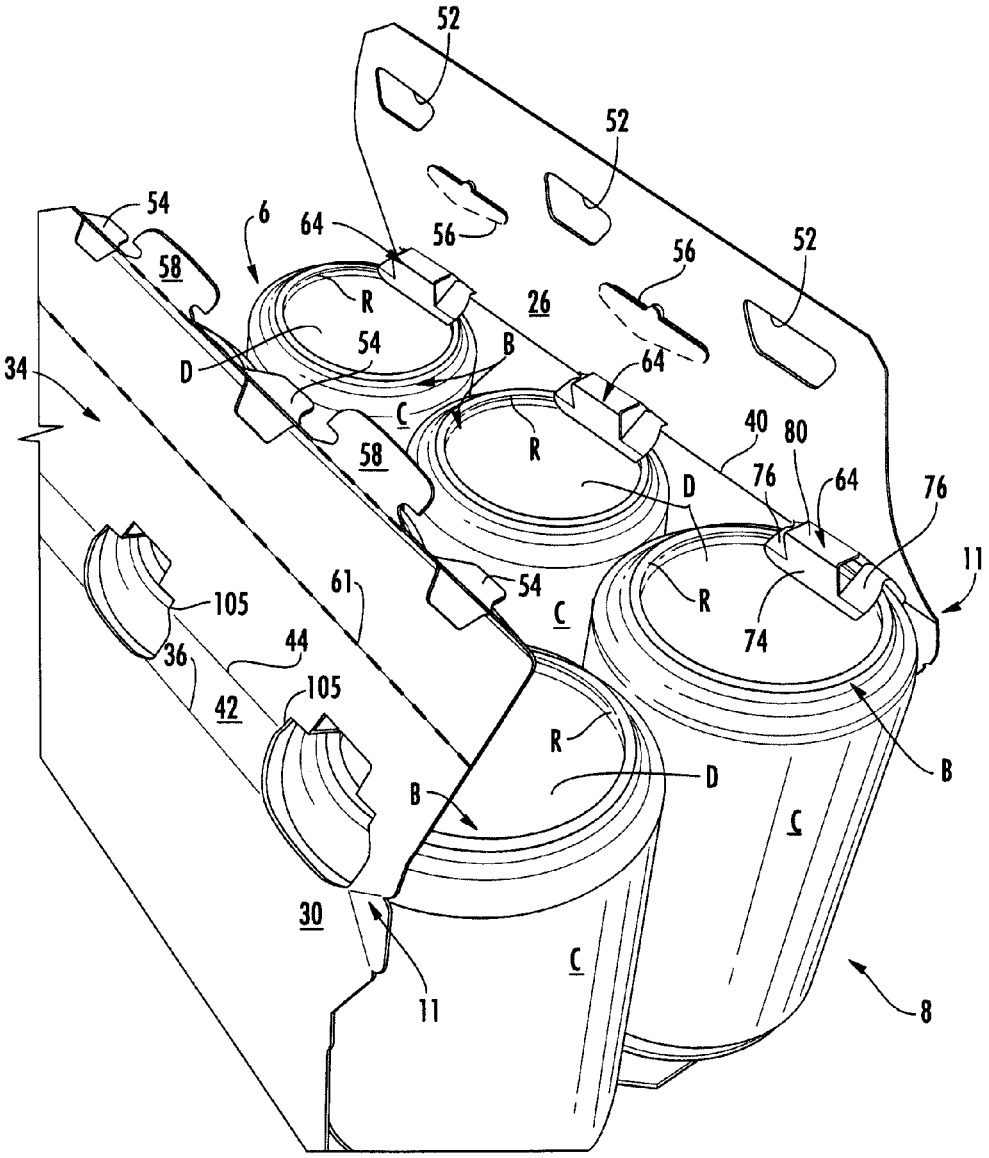
FIG. 3 is a perspective view showing the formation of the carrier around a plurality of articles according to the first exemplary embodiment of the disclosure.
Figure 4:
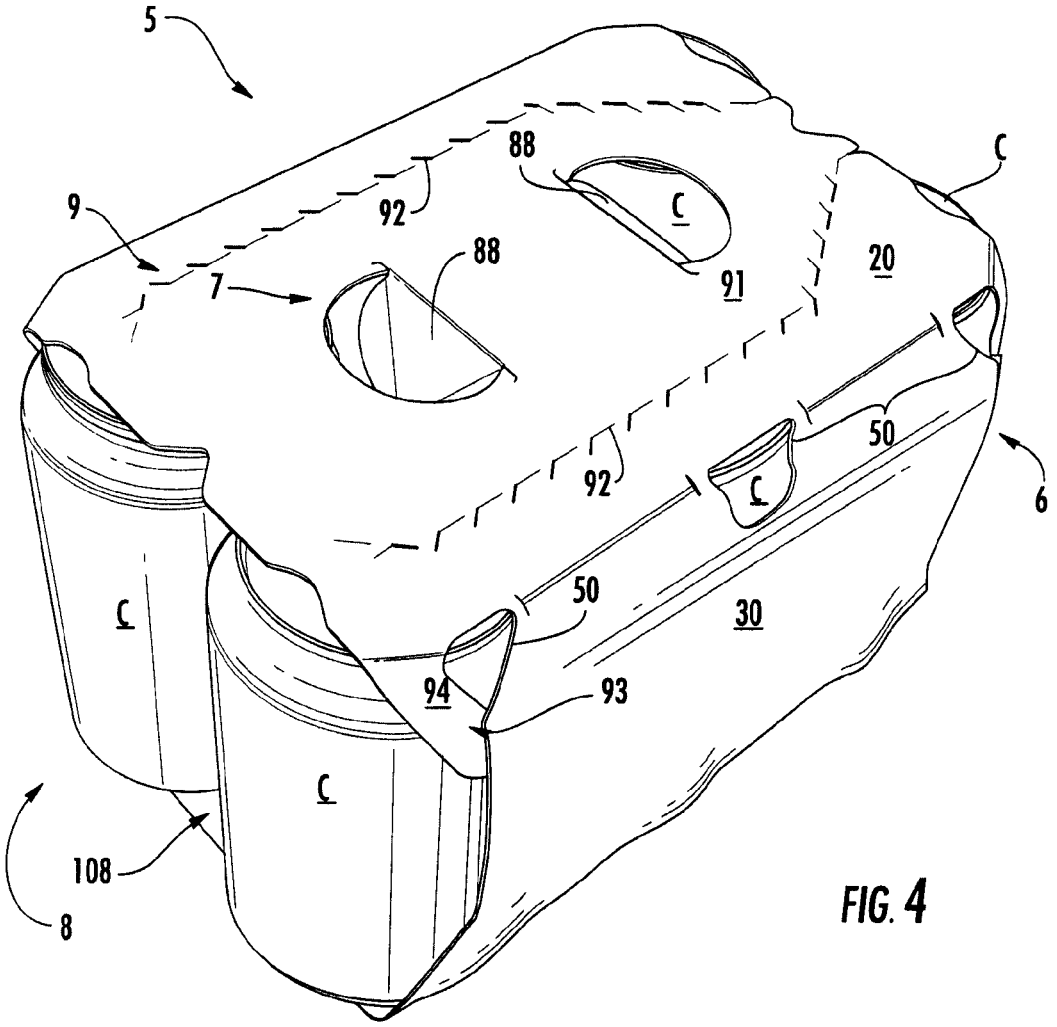
FIG. 4 is a perspective view of the carrier formed from the blank of FIG. 1 with articles retained therein according to the first exemplary embodiment of the disclosure.
Figure 5:
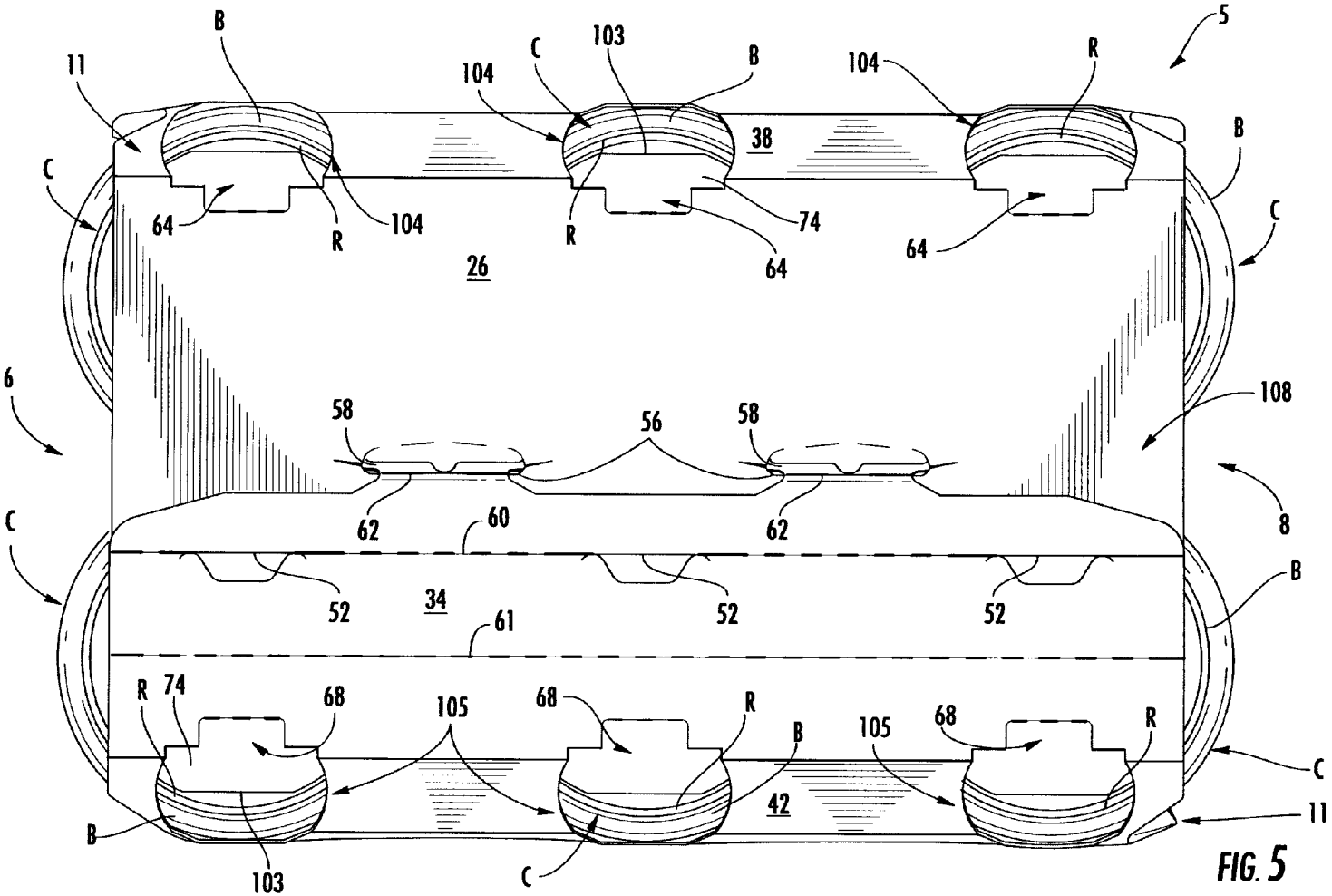
FIG. 5 is a bottom view of the carrier of FIG. 4.
Figure 6:
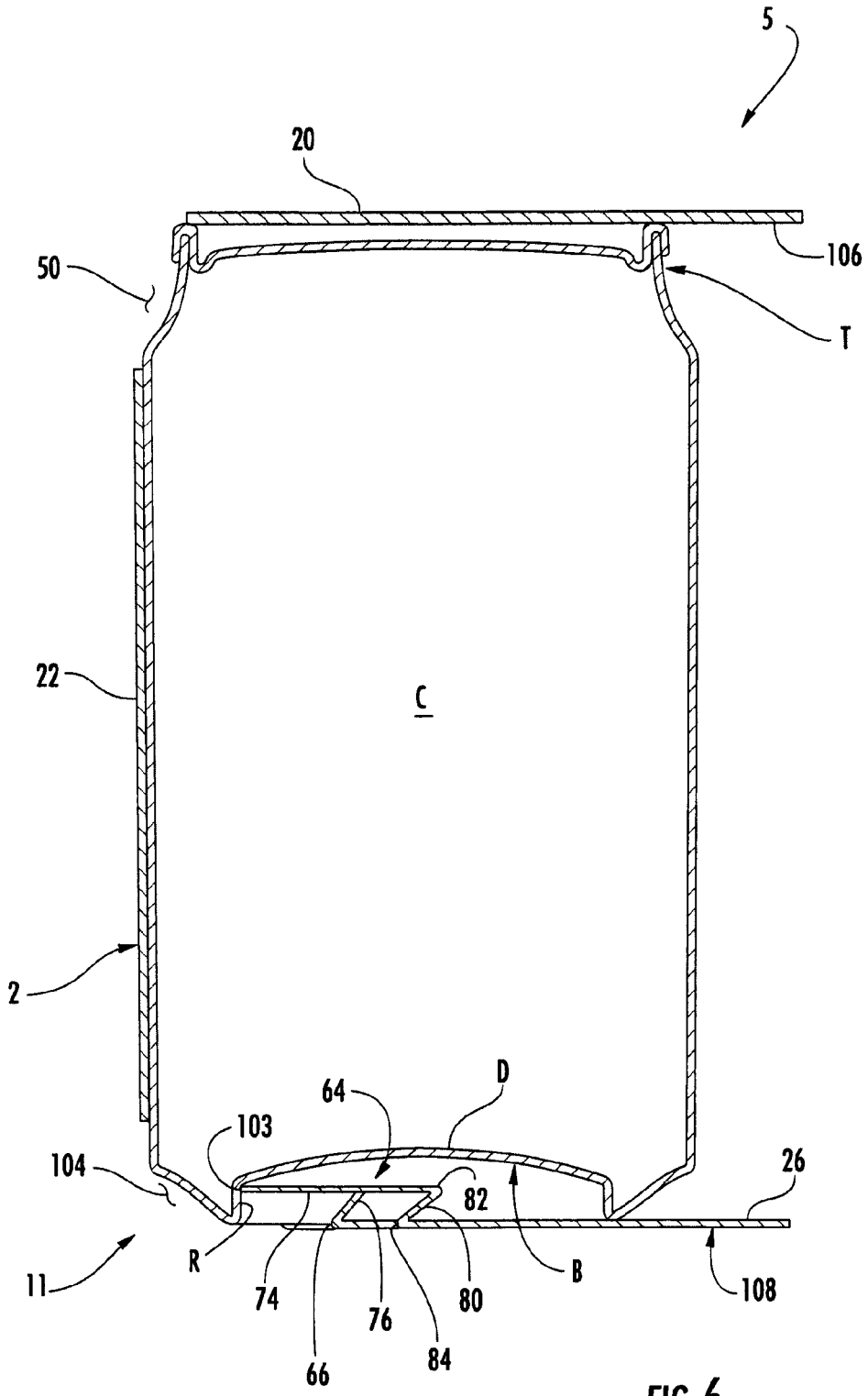
FIG. 6 is a cross-sectional view of the carrier of FIG. 4 according to the first embodiment of the disclosure.

As shown in FIGS. 3, 5, and 6, the bottom portions B of the containers C each have a dome feature D and an inner rim R extending downwardly from the dome feature D. In the illustrated embodiment, each of the first and second retention tabs 64, 68 is positioned to engage at least a portion of an inner rim R of a respective container C (FIGS. 3, 5, and 6). Alternatively, the first and second retention tabs 64, 68 can be omitted or otherwise shaped, arranged, positioned, and/or configured without departing from the disclosure. For example, the distances D1, D2 could be generally equal, or the distance D2 could be greater than the distance D1. In another example, in addition or alternatively to the retention tabs 64, 68 foldably connected to the bottom panels 26, 34, the blank 3 can include one or more upper retention tabs (not shown) foldably connected to the top panel 20, the first side panel 22, and/or the second side panel 30. The upper retention tabs could be similar or identical to the retaining tabs 64, 68 in one alternative embodiment.

As shown in FIG. 1, the handle 7 includes two finger flaps 88, each respectively formed by slits and foldably attached to the top panel 20 at a respective longitudinal fold line 90. The handle 7 could include other features for carrying the carrier 5, the finger flaps 88 could be otherwise positioned, shaped, and/or arranged, or the handle 7 could be omitted from the carrier without departing from the disclosure.

In the illustrated embodiment, the dispenser 9 includes a dispenser panel 91 formed by two tear lines 92 extending in the top panel 20. The dispenser 9 could include other features for opening the carrier 5, the dispenser panel 91 could be otherwise positioned, shaped, and/or arranged, or the dispenser 9 could be omitted from the carrier without departing from the disclosure.

In the illustrated embodiment, the top panel 20 is generally rectangular having top retainer features in the form of a gusset or top retainer 93 located at each corner. The top retainers 93 each include a side retention panel 94 foldably connected to the top panel 20 at an oblique first fold line 95 and a tuck-in panel 96 foldably connected to one of the side panels 22, 30 at second fold line 97. Each tuck-in panel 96 is foldably connected to a respective side retention panel 94 at an oblique third fold 98. Alternatively, the top retainers 93 could be omitted or otherwise shaped, arranged, positioned, and/or configured without departing from the disclosure.

In the illustrated embodiment, the carrier 5 can be erected by positioning the top panel 20 on top of the containers C and folding the side panels 22, 30 downwardly. As the side panels 22, 30 are folded, the tuck-in panels 96 are respectively tucked inwardly about the fold lines 97. Accordingly, the side retention panels 94 are drawn inwardly to extend over the ends 6, 8 of the carrier 5. The side retention panels 94 partially wrap around portions of the containers C at the ends 6, 8 of the carrier 5 to respectively form the top retainers 93 at the four top corners of the carrier 5. The tuck-in panels 96 and side retention panels 94 are held in place by virtue of the tuck-in panels 96 being respectively sandwiched (e.g., held, pinched, etc.) between the containers C and the interior surface 106 of the side panels 22, 30.

Figure 7:
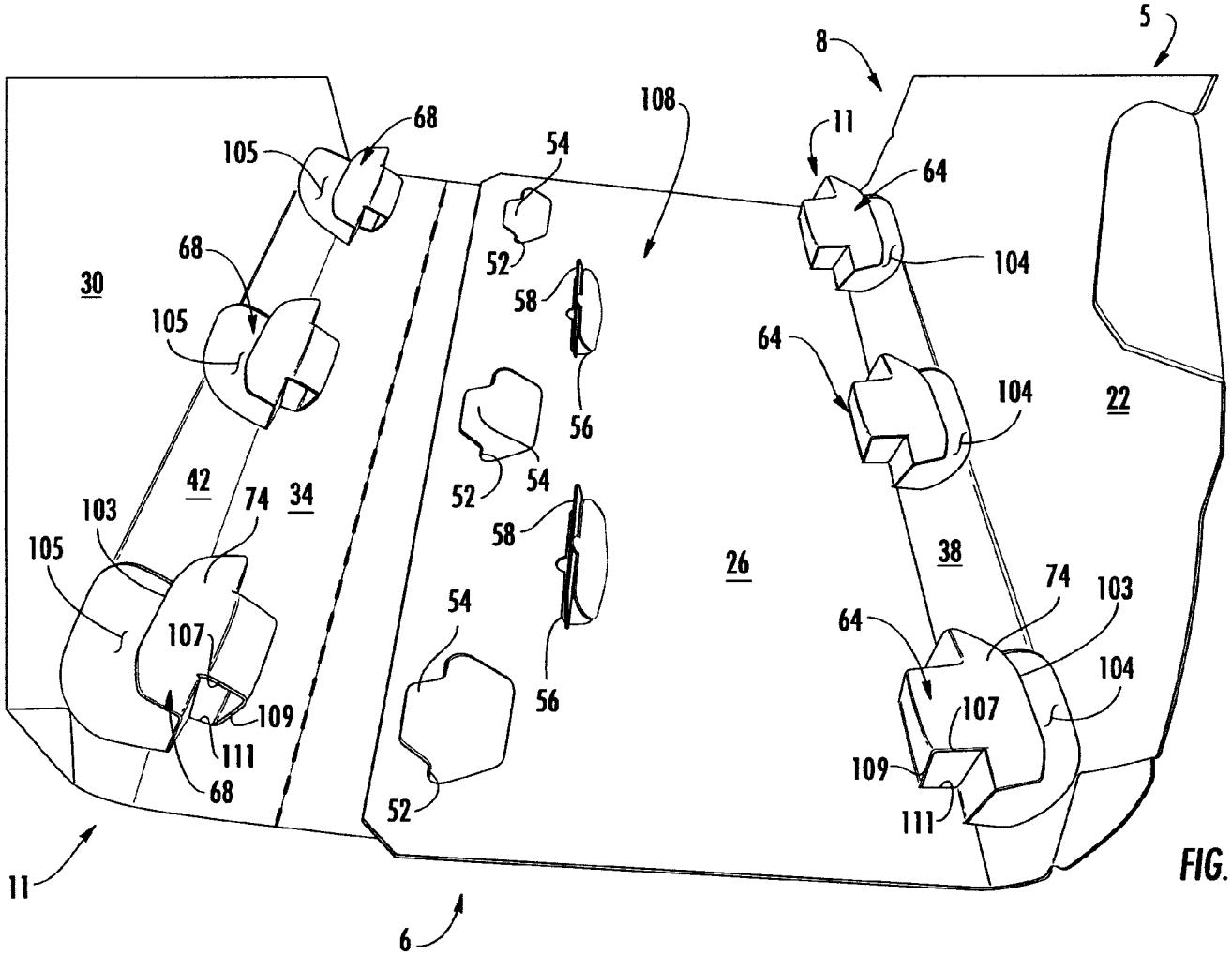
FIG. 7 is a perspective view of an interior of the carrier of FIG. 4 with the articles omitted to show the retention features according to the first exemplary embodiment of the disclosure.

As shown in FIG. 3, the carrier 5 can be erected further by folding the bottom panels 26, 34 inwardly to overlap the bottom panels and form a bottom wall 108 (FIGS. 5 and 7). In one embodiment, as the bottom panels 26, 34 are folded inwardly under the bottom portions B of the containers C, the retention tabs 64, 68 can be pushed inwardly, folding the proximal portions 76, 80 along the respective fold lines 66, 84 and folding the distal portion 74 along the fold lines 78, 82. As the bottom panels 26, 34 continue to fold inwardly, the actuated retention tabs 64, 68 are positioned relative to the bottom portions B of the respective containers C adjacent the respective inner rims R and dome features D. As the bottom panels 26, 34 are folded over the bottoms of the containers C (FIG. 5), the retention tabs 64, 68 pivot to engage the inner rims of the respective containers C.

As shown in FIGS. 5 and 7, the bottom panels 26, 34 can be interlocked to form the bottom wall 108 with the primary locking tabs 54 engaging the respective primary locking edges 52 and the secondary locking tab projections 58 engaging the respective slits 56. In the illustrated embodiment, the first and second bottom panels 26, 34 are folded along the respective fold lines 28, 40 and 36, 44, and the second bottom panel 34 is secured to the first bottom panel 26 by first respectively engaging primary male locking tabs 54 with the primary female locking edges 52. The secondary male locking flaps 58 are respectively inserted through, and cooperatively interact with, the slits 56 to further secure the second bottom panel 34 to the first bottom panel 26. The carrier 5 could be erected and/or the containers C could be loaded by alternative steps without departing from the disclosure.

As shown in FIGS. 6 and 7, the actuated retention tabs 64, 68 are positioned for helping to retain the respective containers C. In the illustrated embodiment, the proximal portions 76 and the offset proximal portions 80 can extend generally upwardly and/or obliquely towards the interior of the carrier 5 from the fold lines 66, 84 and the distal portions 74 can extend generally horizontally (e.g., generally parallel to the bottom wall 108) towards the respectively adjacent side panels 22, 30 from the fold lines 78, 82. Accordingly, for each of the retention tabs 64, 68, the distal portion can have an edge 103 that can abut an interior surface of the inner rim R of the respective container C. A central area of the distal portion 74 of each retention tab can extend farther across the bottom B of the respective container C to the offset fold line 82 than the outer areas of the distal portion. As shown in FIG. 7, the distal portion 74 of each of the retention tabs 64, 68 can have edges extending from the respective ends of the fold lines 78 to the respective ends of the fold line 82, and the edges of the offset proximal portion 80 can continue from the respective edges of the distal portion to the respective bottom panel 26, 34. In an alternative embodiment, the fold line 82 can engage the inner rim R of the respective container C opposite to where the edge 103 contacts the inner rim R.

As shown in FIGS. 5-7, the actuated retention tabs 64 form openings 104 in the first side panel 22 and the first bottom panel 26 for receiving portions of the bottoms B of the respectively adjacent containers C. Similarly, the actuated retention tabs 68 form openings 105 (FIGS. 3, 5, and 7) in the second side panel 30 and the second bottom panel 34 for receiving portions of the bottoms B of the respectively adjacent containers C. In one embodiment, for each of the retention tabs 64, 68, an edge of the respective bottom panel 25, 34 can extend along the respective openings 104, 105 from the each of the ends of the fold lines 84 to the respective fold lines 66.

In the illustrated embodiment, the folded retention tabs 64, 68 can help resist withdrawal of the containers C by providing multiple contact points along an edge of the respective distal portion 74, proximal portions 76, and offset proximal portions 80, which contact points can engage the inner rim R extending downwardly from the dome feature D of the respective container C. For example, a container C can be forced outwardly toward the end 6 of the carrier 5 and the respective first retention tab 64 can contact the interior of the inner rim R in the interior 100 of the carrier 5 and resist the outward force. The top retainers 93 resist removal of the containers C at the top corners of the carrier 5 at the ends 6, 8 (FIG. 6), and the retention tabs 64, 68 cooperate with the top retainers 93 to help resist pivoting of the containers C at the ends 6, 8, which pivoting may allow the container to disengage from the respective retention tab 64, 68 or top retainer 93. Accordingly, the retention tabs 64, 68 and the top retainers 93 help prevent undesired ejection of the containers C from the carrier 5.

In one embodiment, the containers C can rotate while retained in the carrier 5, wherein the circular inner rim R of a container C can slide past the edge 103 of the distal portion 74 of the respective retention tab 64, 68 as the container rotates. Such rotating can occur naturally (e.g., during transportation of the carrier 5 and containers C) and/or manually (e.g., to orient the containers to show labeling). Since distal portions 74 of the retention tabs 64, 68 are held in a generally horizontal position (e.g., FIG. 6) by the configuration of the proximal portions 76 and the offset proximal portion 80, the retention tabs 64, 68 are less likely to rub against the dome features D of the containers C when the containers are moved relative to the retention tabs (e.g., rotated). Expiration dates and/or other information may be printed on the bottoms of the containers C (e.g., on the dome features D), and such printed material could be rubbed off by alternative retention features that are not spaced from the dome features D like the retention features 64, 68.

Figure 8:
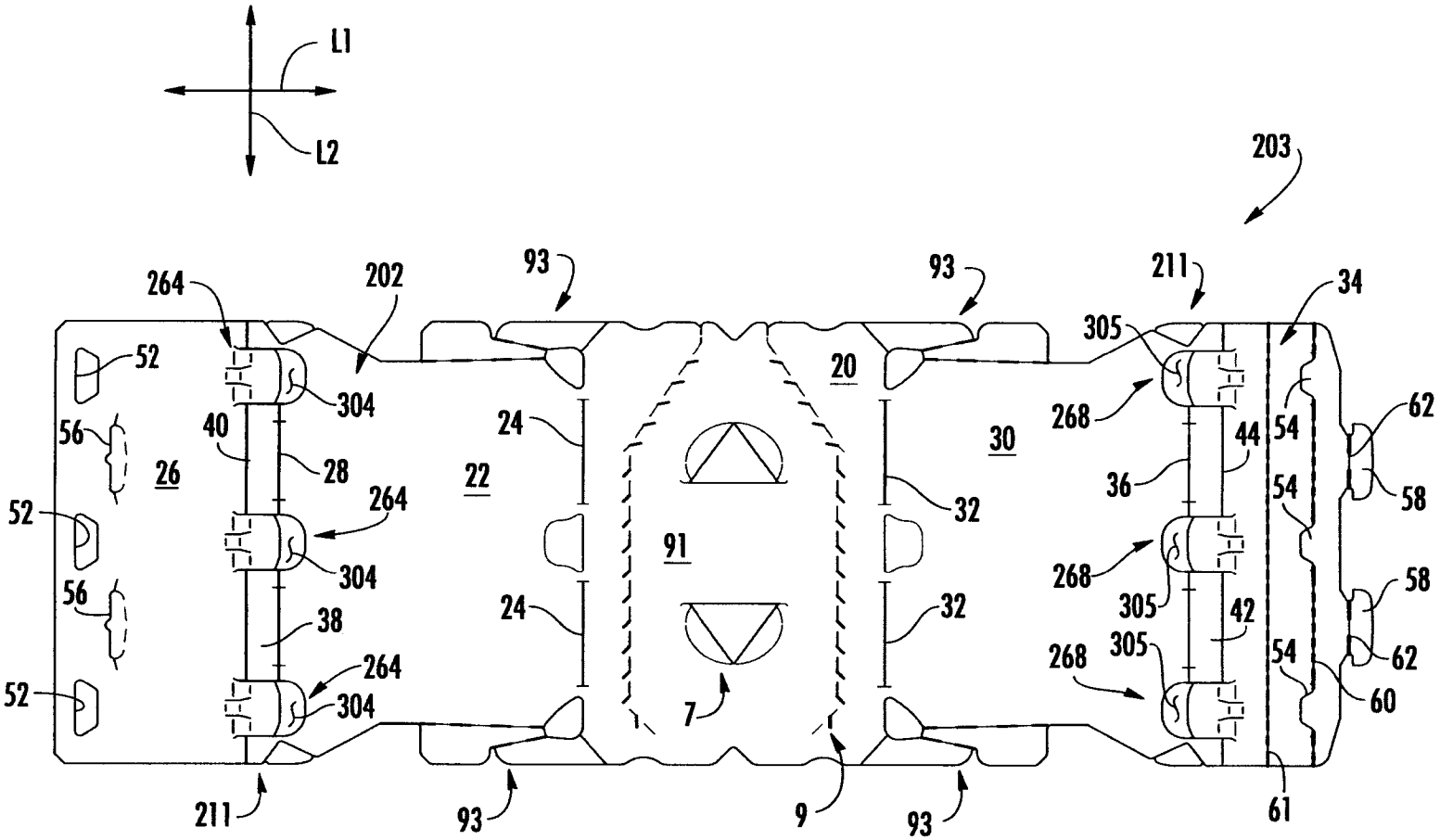
FIG. 8 is a plan view of an exterior surface of a blank used to form a carrier according to a second embodiment of the disclosure.
Figure 9B:
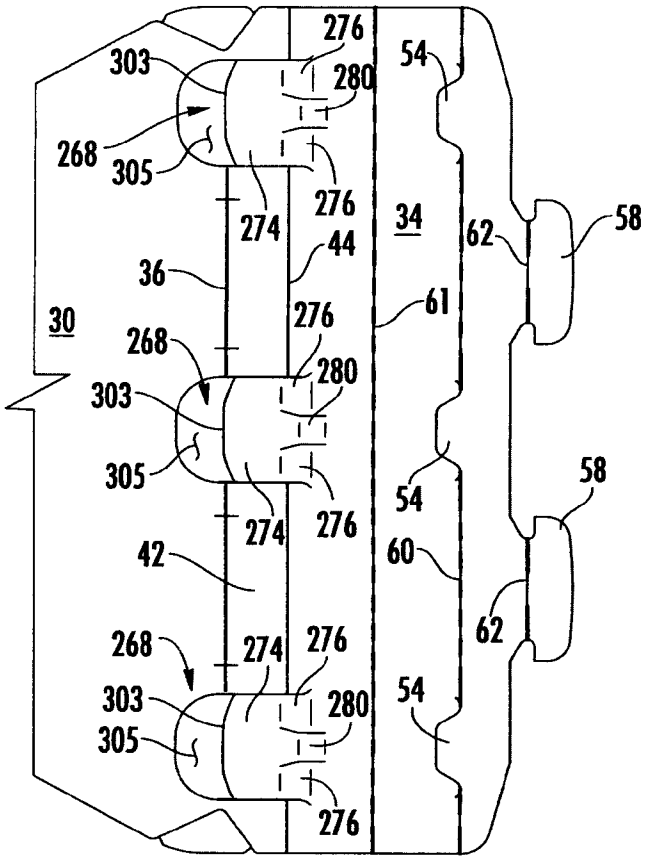
FIGS. 9A and 9B are views of respective bottom panels and retention features in the blank of FIG. 8.
Figure 9A:
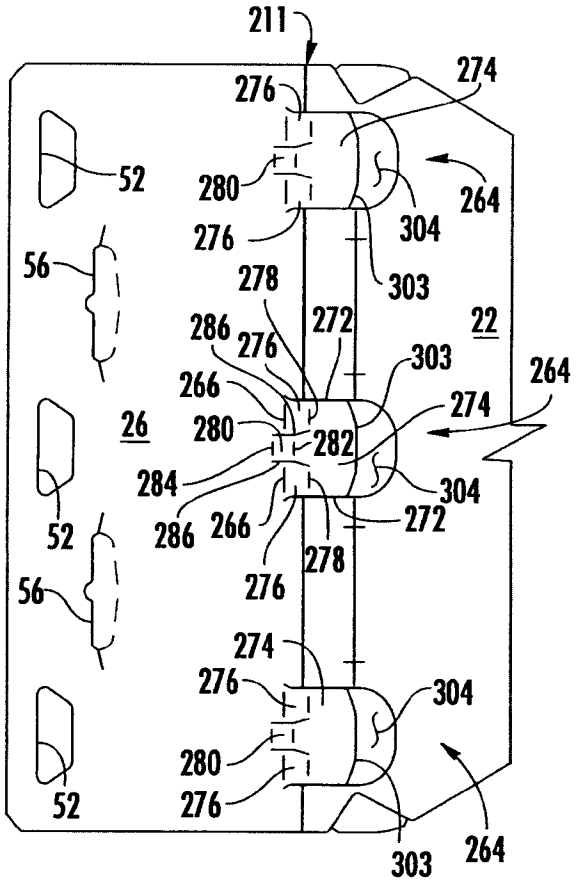
Figure 10:
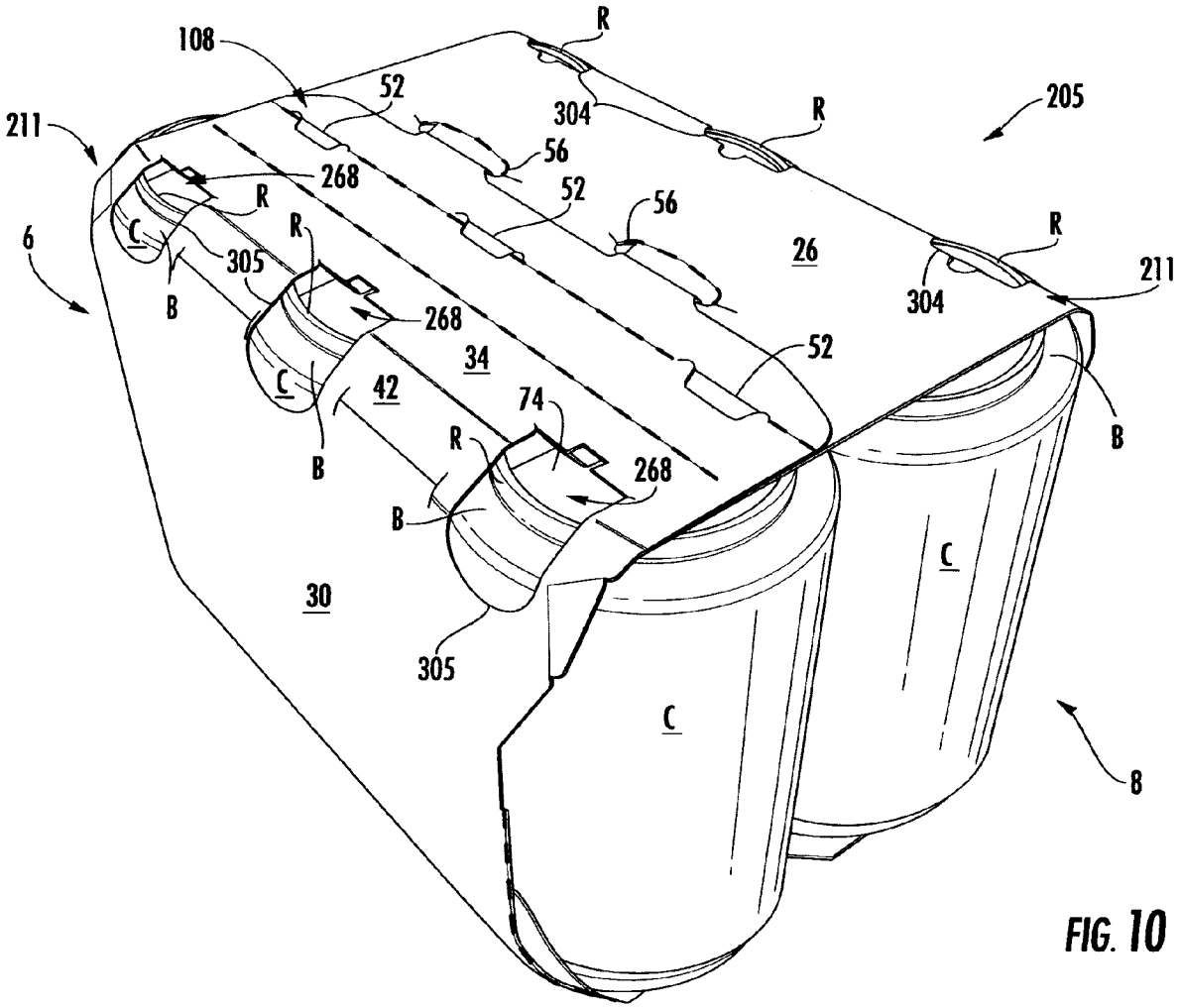
FIG. 10 is a bottom perspective view of the erected carrier formed from the blank of FIG. 8 with articles retained therein according to the second exemplary embodiment of the disclosure.
Figure 11:
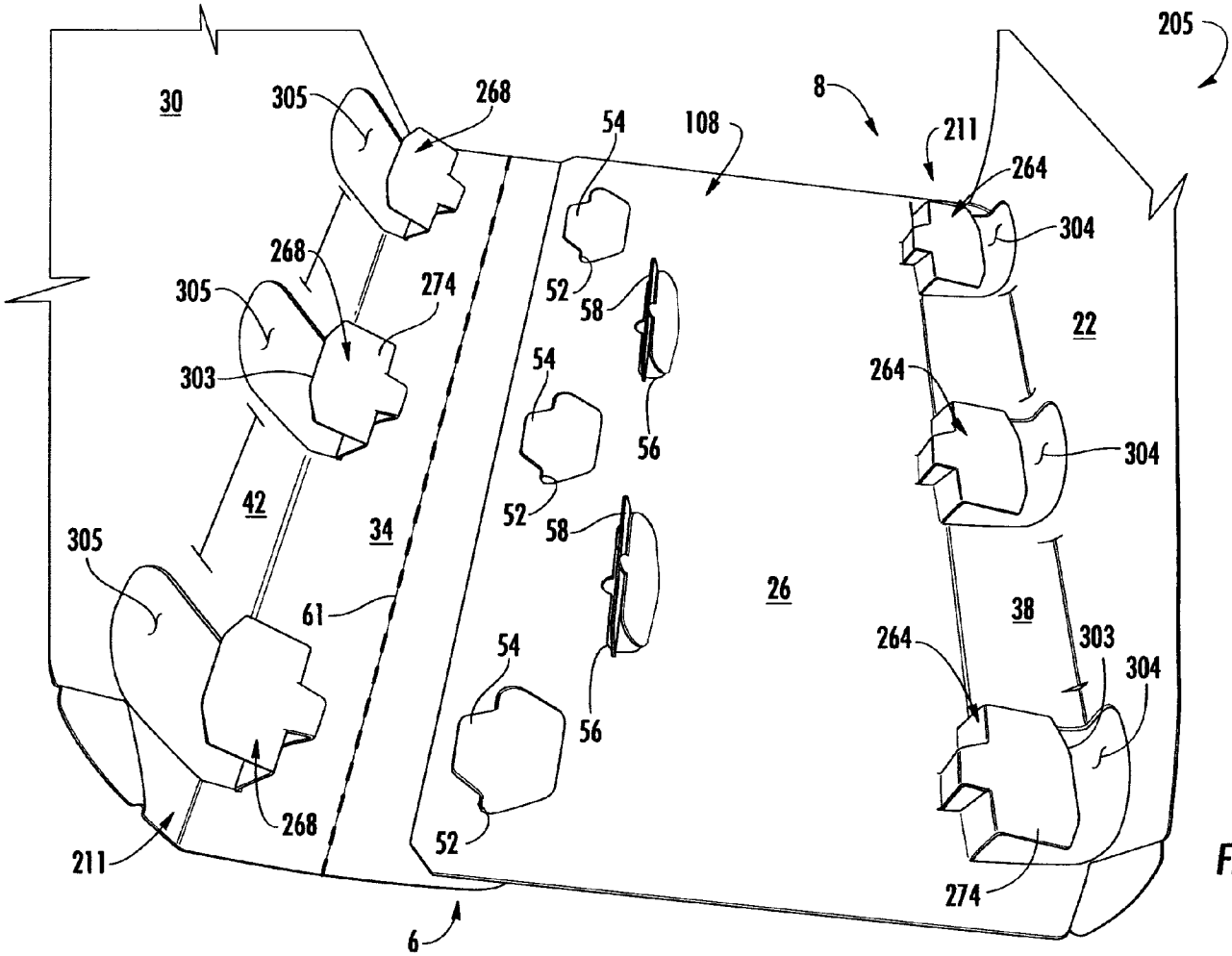
FIG. 11 is a perspective view of an interior of the carrier of FIG. 10 with the articles omitted to show the retention features according to the second exemplary embodiment of the disclosure.

FIG. 8 is a plan view of an exterior surface 202 of a blank 203 for forming a carrier 205 (FIGS. 10 and 11) according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 8, 9A, and 9B, the blank 203 includes alternative bottom retention features 211 including retention tabs 264, 268 disposed adjacent respective openings 304, 305. The retention tabs 264, 268 are similar to the retention tabs 64, 68 of the first embodiment with a distal portion 274 foldably connected to two proximal portions 276 and an offset proximal portion 280. The offset proximal portions 280 of each retention tab 264, 268 can be relatively smaller than the offset proximal portions 80 of the first embodiment, and the cut lines 286 can have longitudinal proximal portions and oblique distal portions as shown in FIGS. 8, 9A, and 9B. Each of the retention tabs 264, 268 can have a respective distal edge 303 adjacent the respective opening 304, 305 for engaging the inner rims R of the respective containers C (FIG. 10) in the illustrated embodiment. As shown in FIGS. 10 and 11, the actuated retention tabs 264, 268 are generally similar to the retention tabs 64, 68 of the first embodiment. The blank 203 could be otherwise shaped, arranged, and/or configured without departing from the disclosure.

Figure 12:
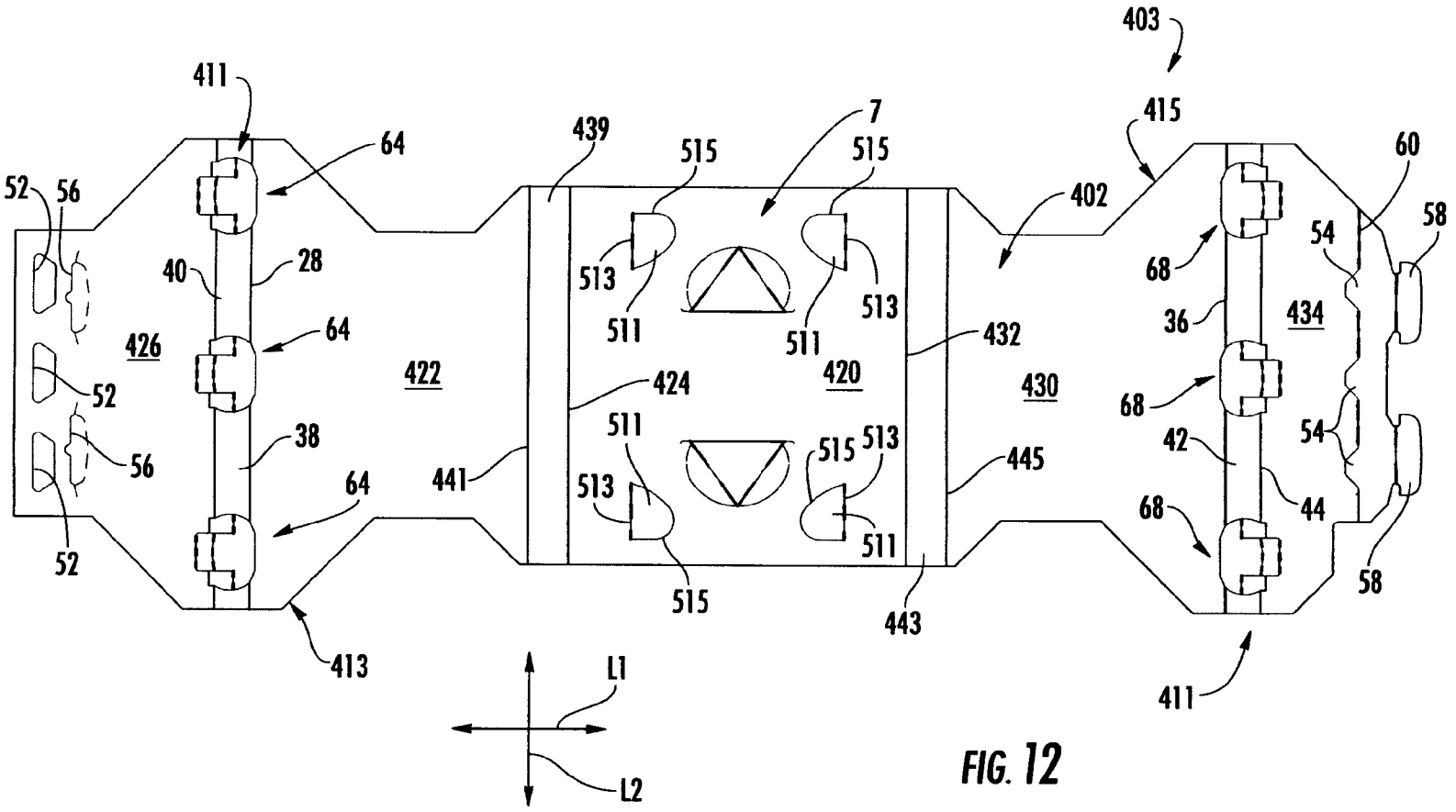
FIG. 12 is a plan view of an exterior surface of a blank used to form a carrier according to a third embodiment of the disclosure.
Figure 13:
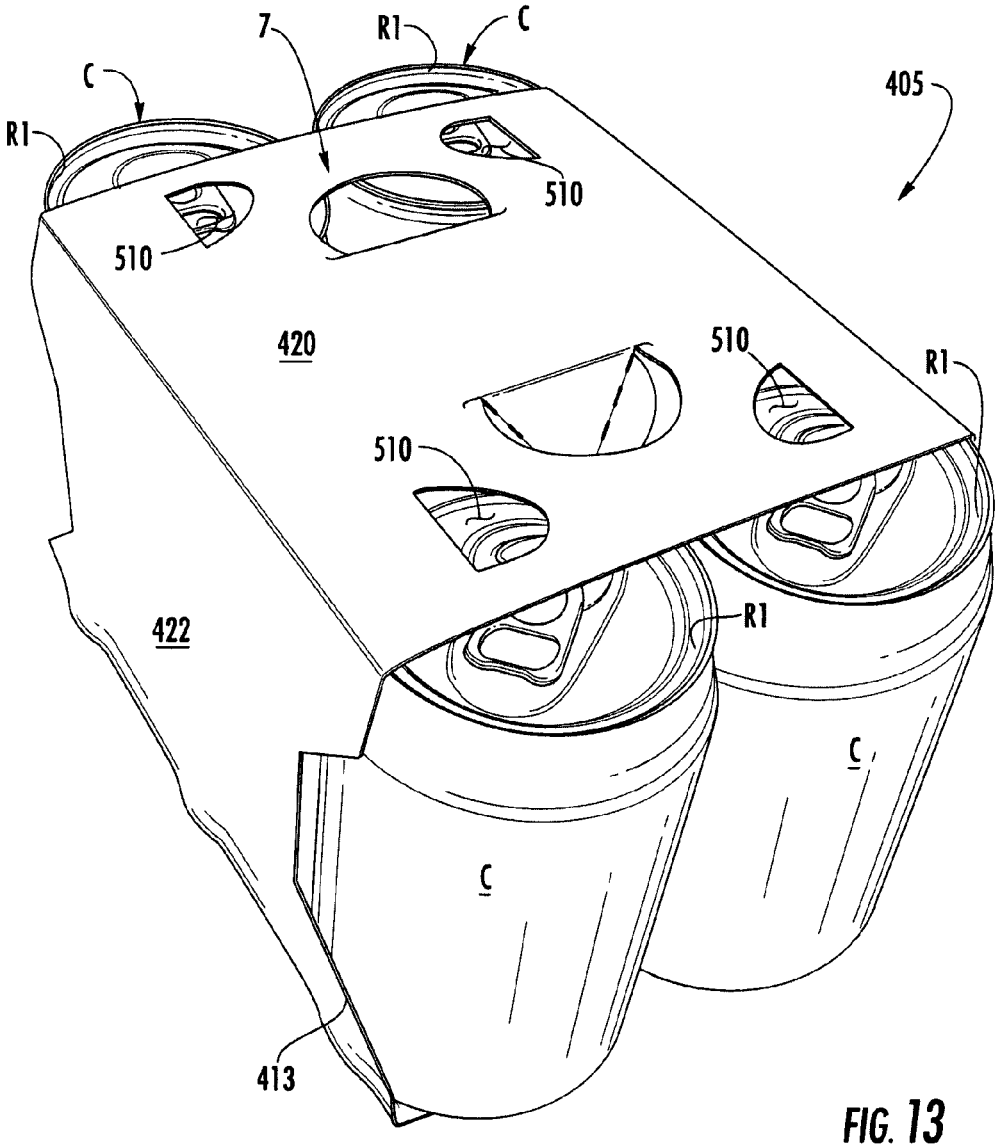
FIG. 13 is a perspective view of the carrier formed from the blank of FIG. 12 with articles retained therein according to the third exemplary embodiment of the disclosure.
Figure 14:
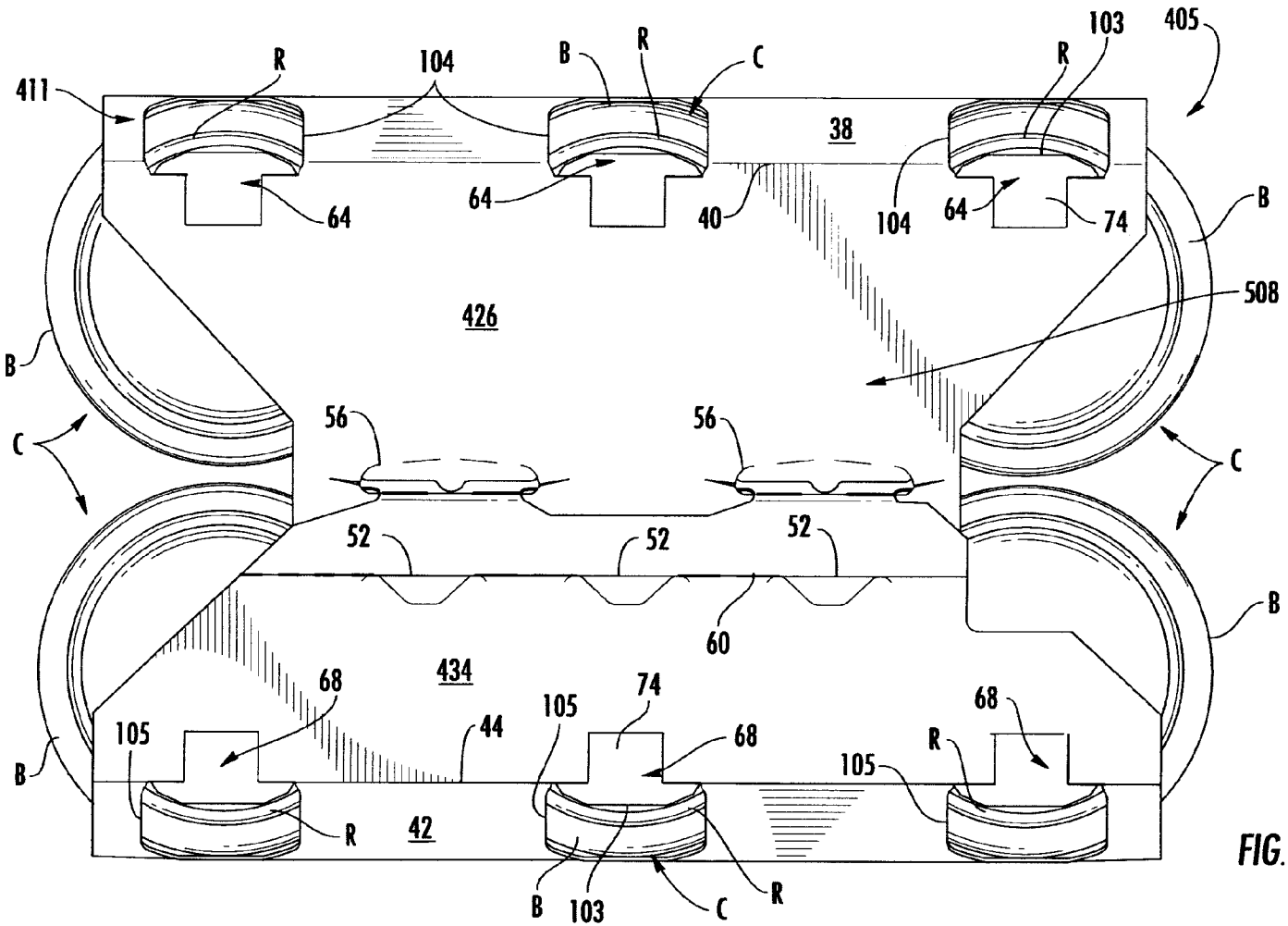
FIG. 14 is a bottom view of the carrier of FIG. 13.

FIG. 12 is a plan view of an exterior surface 402 of a blank 403 for forming a carrier 405 (FIGS. 13 and 14) according to a second embodiment of the disclosure. The third embodiment is generally similar to the first embodiment, except for variations noted and variations that will be apparent to one of ordinary skill in the art. Accordingly, similar or identical features of the embodiments have been given like or similar reference numbers. As shown in FIG. 12, the blank 403 has an alternative shape with a widened section 413 including portions of the first side panel 422 and the first bottom panel 426 and a widened section 415 including portions of the second side panel 430 and the second bottom panel 434 for accommodating the respective retention features 411. The retention features 411 can include retention tabs 64, 68 that are generally the same as the retention tabs of the first embodiment. As shown in FIG. 12, the top panel 420 includes top retention tabs 511 foldably connected to the top panel 420 along lateral fold lines 513 and separable from the top panel 420 along tear or cut lines 515. The retention tabs 511 can form openings 510 in top panel 420 when actuated in the illustrated embodiment. As shown in FIG. 13, the retention tabs 511 can engage a top rim of the respective containers C adjacent the ends of the carrier 405 to help retain the containers C in the carrier 5. The side panels 422, 430 can include respective upper bevel panels 439, 443 foldably connected to the top panel 420 along respective fold lines 424, 432. The upper bevel panels 439, 443 can be foldably connected to the respective side panels 422, 430 along respective fold lines 441, 445. The bottom bevel panels 38, 42 and the upper bevel panels 439, 443 can extend obliquely with respect to the side panels 422, 430 to at least partially conform to the containers C when the carrier is formed from the blank 403. The bottom panels 426, 434 can be interlocked to form a bottom wall 508 (FIG. 14) similarly to the bottom panels 26, 34 in the first embodiment. The blank 403 could be otherwise shaped, arranged, and/or configured without departing from the disclosure.

Figure 15:
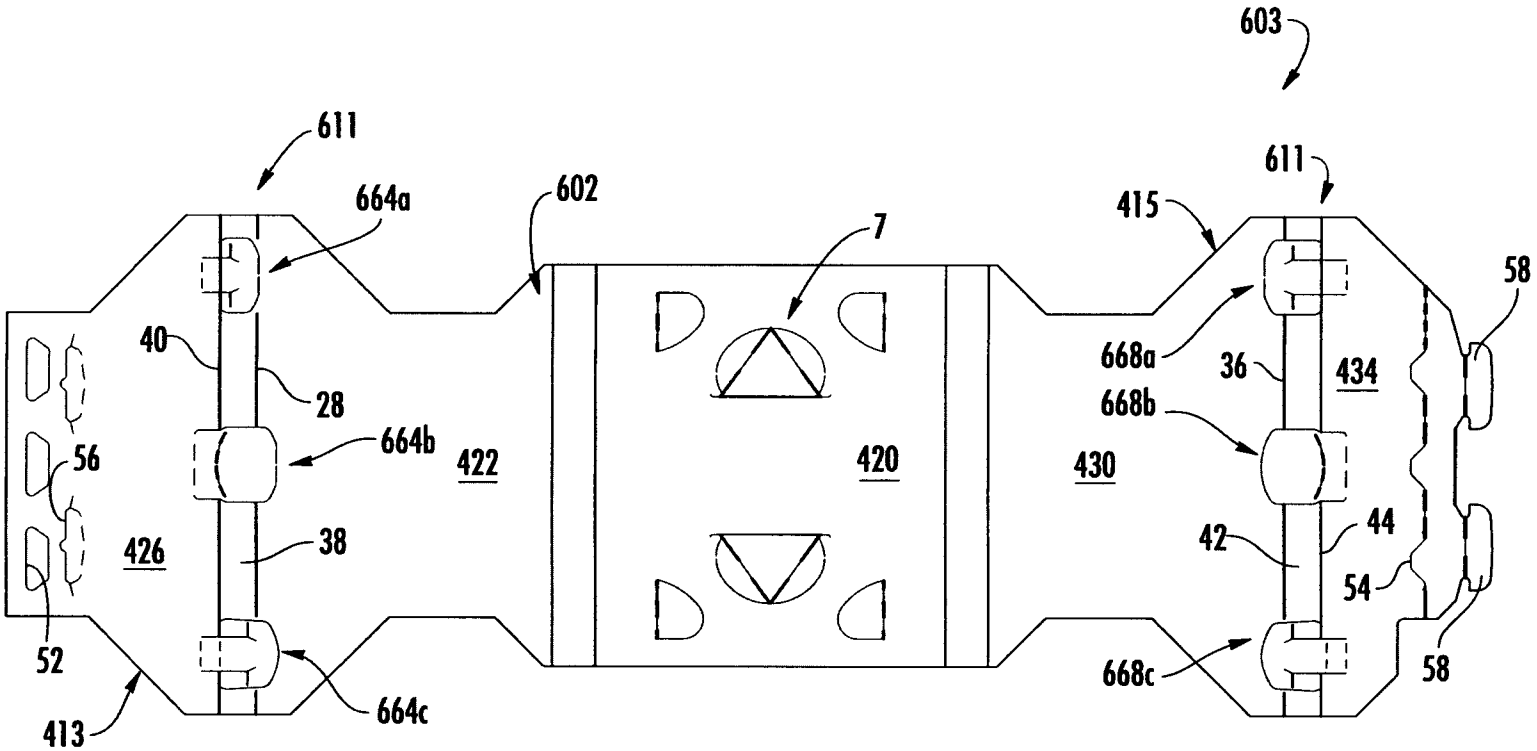
FIG. 15 is a plan view of an exterior surface of a blank used to form a carrier according to a fourth embodiment of the disclosure.
Figure 16A:
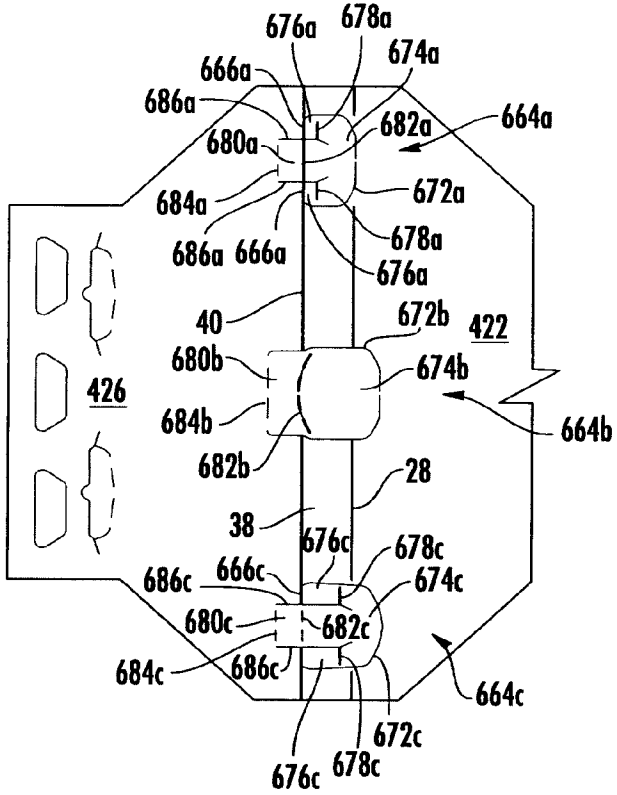
FIGS. 16A and 16B are views of the respective bottom panels and retention features in the blank of FIG. 15.
Figure 16B:
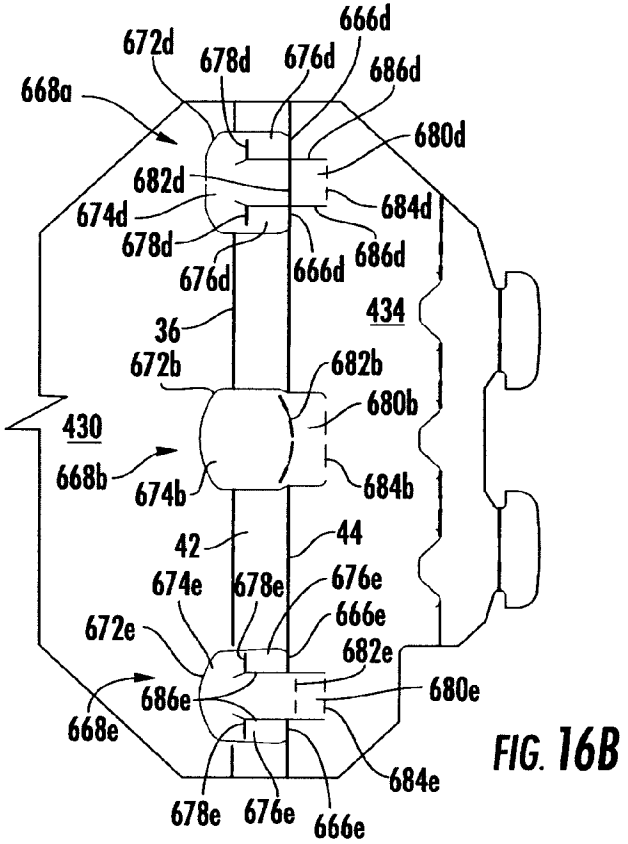

FIG. 15 is a plan view of an exterior surface 602 of a blank 603 for forming a carrier (not shown) according to a second embodiment of the disclosure. The fourth embodiment is generally similar to the third embodiment, except for variations noted and variations that will be apparent to one of ordinary skill in the art. Accordingly, similar or identical features of the embodiments have been given like or similar reference numbers. As shown in FIGS. 15, 16A, and 16B, the blank 603 includes alternative bottom retention features 611 including first retention tabs 664*a*, 664*b*, 664*c* in the first side panel 422 and the first bottom panel 426 and second retention tabs 668*a*, 668*b*, 668*c* in the second side panel 430 and the second bottom panel 434.

As shown in FIG. 16A, the outer retention tabs 664*a*, 664*c* have different shapes; however, the respective proximal portions 676*a*, 676*c* are foldably connected to the first bottom panel 426 along respective fold lines 666*a*, 666*c*, which are generally collinear with the fold line 40 connecting the bottom bevel panel 38 to the first bottom panel 426. Additionally, the distal portions 674*a*, 674*c* of the respective outer retention tabs 664*a*, 664*c* are foldably connected to the respective offset proximal portions 680*a*, 680*c* along respective fold lines 682*a*, 682*c*, which are generally collinear with the lateral fold line 40 and the fold lines 666*a*, 666*c*. As shown in FIG. 16B, the outer retention tabs 668*a*, 668*c* are generally similar to the respective outer retention tabs 664*a*, 664*c* in FIG. 16A, except that the outer retention tab 668*a* is generally larger in the longitudinal direction L1 than the outer retention tab 664*a* and the fold line 682*e* of the outer retention tab 668*c* is slightly offset from the fold line 44.

As shown in FIGS. 16A and 16B, the center retention tabs 664*b*, 668*b* can include a distal portion 674*b* foldably connected to a single proximal portion 680*b* along a curved fold line 682*b*. The proximal portions 680*b* of the center retention tabs 664*b*, 668*b* can be foldably connected to the respective bottom panels 426, 434 along respective fold lines 684*b*. Any or all of the retention tabs 664*a*, 664*b*, 664*c*, 668*a*, 668*b*, 668*c* could be otherwise shaped, arranged, and/or configured or could be omitted without departing from the disclosure. Additionally, the blank 603 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure. Further, it is noted that the retention features of the various embodiments can be incorporated into a carton or carrier having any carton style or panel configuration. The carrier styles and panel configurations described above are included by way of example. Additionally, the shapes of the retention features can be substantially any shape. The shapes described above and included in the figures are included by way of example.

In general, the blanks according to the present disclosure can be constructed from paperboard having a caliper so that it is heavier and more rigid than ordinary paper. The blanks can also be constructed of other materials, such as cardboard, or any other material having properties suitable for enabling the carton to function at least generally as described above. The blanks can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of articles, the carrier comprising:

a plurality of panels at least partially extending around an interior of the carrier, the plurality of panels comprising at least a bottom panel; and a retention tab for engaging at least a portion of an article of the plurality of articles, the retention tab being foldably connected to at least the bottom panel adjacent an opening in at least the bottom panel, the retention tab comprising a distal portion foldably connected to a first proximal portion along a first fold line, foldably connected to a second proximal portion along a second fold line, and foldably connected to a third proximal portion along a third fold line, the first fold line being spaced apart from the second fold line, wherein the distal portion is generally spaced apart from the bottom panel for engaging at least a bottom portion of the at least one article;

each of the first proximal portion, the second proximal portion, and the third proximal portion extends from the bottom panel to the distal portion and are foldably connected to the bottom panel;

a first edge of the distal portion extends between the first fold line and the second fold line; and a second edge of the distal portion extends between the third fold line and the second fold line.

2. The carrier of claim 1, wherein the distal portion is generally parallel to the bottom panel.

3. The carrier of claim 1, wherein the third fold line is generally collinear with the first fold line.

4. The carrier of claim 1, wherein a portion of the distal portion extends between respective ends of the first fold line and the third fold line.

5. The carrier of claim 1, wherein the first edge of the distal portion extends from an end of the first fold line to an end of the second fold line.

6. The carrier of claim 1, wherein the first proximal portion is foldably connected to the bottom panel along a fourth fold line, the second proximal portion is foldably connected to the bottom panel along a fifth fold line, and the fourth fold line is spaced apart from the fifth fold line.

7. The carrier of claim 6, wherein the first fold line, the second fold line, the third fold line, and the fourth fold line are generally parallel with one another.

8. The carrier of claim 6, wherein the fourth fold line is spaced apart from the first fold line by a first distance, the fifth fold line is spaced apart from the second fold line by a second distance, and the first distance is greater than the second distance.

9. A carrier for holding a plurality of articles, the carrier comprising:

a plurality of panels at least partially extending around an interior of the carrier, the plurality of panels comprising at least a bottom panel; and a retention tab for engaging at least a portion of an article of the plurality of articles, the retention tab being foldably connected to at least the bottom panel adjacent an opening in at least the bottom panel, the retention tab comprising a distal portion foldably connected to a first proximal portion along a first fold line and to a second proximal portion along a second fold line, the first fold line being spaced apart from the second fold line, wherein the distal portion is generally spaced apart from the bottom panel for engaging at least a bottom portion of the at least one article; and each of the first proximal portion and the second proximal portion extends from the bottom panel to the distal portion and are foldably connected to the bottom panel, the first proximal portion is foldably connected to the bottom panel along a third fold line, the second proximal portion is foldably connected to the bottom panel along a fourth fold line, and the third fold line is spaced apart from the fourth fold line, wherein an edge of the bottom panel extends from the third fold line to the fourth fold line along the opening.

10. The carrier of claim 1, wherein the plurality of panels further comprises a side panel foldably connected to the bottom panel along a fourth fold line, and the opening extends into the side panel, interrupting the fourth fold line.

11. The carrier of claim 10, wherein the bottom panel comprises a bottom bevel panel at least partially defined by the fourth fold line, the opening extending in the bottom bevel panel.

12. The carrier of claim 1, wherein the bottom panel is a first bottom panel, the retention tab is a first retention tab, the plurality of panels further comprises a second bottom panel at least partially in an overlapping relationship with the first bottom panel, and the carrier further comprises a second retention tab foldably connected to the second bottom panel.

13. The carrier of claim 1 in combination with an article of the plurality of articles, the bottom portion of the article comprising a dome feature and an inner rim extending generally downwardly from the dome feature, wherein the distal portion of the retention tab engages the inner rim.

14. The combination of claim 13, wherein a distal edge of the distal portion engages the inner rim of the article, the distal edge being disposed opposite to the first proximal portion and the second proximal portion.

15. The combination of claim 13, wherein a portion of the distal portion proximate the first proximal portion and the second proximal portion is generally spaced apart from the dome feature of the article.

16. A blank for forming a carrier for holding a plurality of articles, the blank comprising:

a plurality of panels comprising at least a bottom panel; and a retention tab for engaging at least a portion of an article of the plurality of articles when the carrier is formed from the blank, the retention tab being foldably connected to at least the bottom panel and being at least partially separable from the bottom panel along at least one cut, the retention tab comprising a distal portion foldably connected to a first proximal portion along a first fold line, foldably connected to a second proximal portion along a second fold line, and foldably connected to a third proximal portion along a third fold line, the first fold line being spaced apart from the second fold line, wherein each of the first proximal portion, the second proximal portion, and the third proximal portion is foldably connected to the bottom panel, and the distal portion is for being generally spaced apart from the bottom panel for engaging a bottom portion of the at least one article when the carrier is formed from the blank, and the distal portion is at least partially separable from the first proximal portion along a first cut line extending at least from the first fold line to the second fold line and is at least partially separable from the third proximal portion along a second cut line extending at least from the third fold line to the second fold line.

17. The blank of claim 16, wherein the third fold line is generally collinear with the first fold line.

18. The blank of claim 16, wherein a portion of the distal portion extends between respective ends of the first fold line and the third fold line.

19. The blank of claim 16, wherein the distal portion is at least partially separable from the first proximal portion along a cut line extending at least from the first fold line to the second fold line.

20. A blank for forming a carrier for holding a plurality of articles, the blank comprising:

a plurality of panels comprising at least a bottom panel; and a retention tab for engaging at least a portion of an article of the plurality of articles when the carrier is formed from the blank, the retention tab being foldably connected to at least the bottom panel and being at least partially separable from the bottom panel along at least one cut, the retention tab comprising a distal portion foldably connected to a first proximal portion along a first fold line and to a second proximal portion along a second fold line, the first fold line being spaced apart from the second fold line, wherein each of the first proximal portion and the second proximal portion is foldably connected to the bottom panel, and the distal portion is for being generally spaced apart from the bottom panel for engaging a bottom portion of the at least one article when the carrier is formed from the blank, the distal portion is at least partially separable from the first proximal portion along a cut line extending at least from the first fold line to the second fold line, the second proximal portion is foldably connected to the bottom panel along a third fold line, the cut line further extends at least from the second fold line to the third fold line, and the second proximal portion is at least partially separable from the first proximal portion and the bottom panel along the cut line.

21. The blank of claim 16, wherein the distal portion is at least partially separable from the first proximal portion along a cut line extending at least from an end of the first fold line to an end of the second fold line.

22. The blank of claim 16, wherein the first proximal portion is foldably connected to the bottom panel along a fourth fold line, the second proximal portion is foldably connected to the bottom panel along a fifth fold line, and the fourth fold line is spaced apart from the fifth fold line.

23. The blank of claim 22, wherein the first fold line, the second fold line, the third fold line, and the fourth fold line are generally parallel with one another.

24. The blank of claim 22, wherein the third proximal portion is foldably connected to the bottom panel along a sixth fold line, the fourth fold line is generally collinear with the sixth fold line.

25. The blank of claim 22, wherein the second proximal portion is at least partially separable from the bottom panel along a cut line extending at least from the fourth fold line to the fifth fold line.

26. The blank of claim 16, wherein the plurality of panels further comprises a side panel foldably connected to the bottom panel along a fourth fold line, and the retention panel is further separable from the side panel along the at least one cut so that the at least one cut and the retention panel interrupt the fourth fold line.

27. The blank of claim 16, wherein the plurality of panels further comprises a side panel foldably connected to the bottom panel along a fourth fold line, and an opening extends adjacent the retention tab into the side panel, interrupting the fourth fold line.

28. The blank of claim 27, wherein the bottom panel comprises a bottom bevel panel at least partially defined by the fourth fold line, the retention tab being at least partially separable from the bottom bevel panel along the at least one cut.

29. The blank of claim 16, wherein the bottom panel is a first bottom panel, the retention tab is a first retention tab, the plurality of panels further comprises a second bottom panel for being disposed in an at least partially overlapping relationship with the first bottom panel when the carrier is formed from the blank, and the blank further comprises a second retention tab foldably connected to the second bottom panel.

30. A method of forming a carrier for holding a plurality of articles, the method comprising:

obtaining a blank comprising a plurality of panels comprising at least a bottom panel, and a retention tab foldably connected to at least the bottom panel and being at least partially separable from the bottom panel along at least one cut line, the retention tab comprising a distal portion foldably connected to a first proximal portion along a first fold line, foldably connected to a second proximal portion along a second fold line, and foldably connected to a third proximal portion along a third fold line, the first fold line being spaced apart from the second fold line, each of the first proximal portion, the second proximal portion, and the third proximal portion are foldably connected to the bottom panel;

forming at least a portion of an interior of the carton by folding the plurality of panels relative to one another; and positioning the retention tab for engaging at least a bottom portion of at least one article of the plurality of articles, the positioning the retention tab comprising positioning the distal portion of the retention tab to be generally spaced apart from the bottom panel so that each of the first proximal portion and the second proximal portion extends from the bottom panel to the distal portion, so that a first edge of the distal portion extends between the first fold line and the second fold line and a second edge of the distal portion extends between the third fold line and the second fold line, and so that the retention tab is foldably connected to at least the bottom panel adjacent an opening at least in the bottom panel.

31. The method of claim 30, wherein the positioning the distal portion of the retention tab comprises positioning the third proximal portion to extend from the bottom panel to the distal portion.

32. The method of claim 31, wherein a portion of the distal portion extends between respective ends of the first fold line and the third fold line.

33. A method of forming a carrier for holding a plurality of articles, the method comprising:

obtaining a blank comprising a plurality of panels comprising at least a bottom panel, and a retention tab foldably connected to at least the bottom panel and being at least partially separable from the bottom panel along at least one cut line, the retention tab comprising a distal portion foldably connected to a first proximal portion along a first fold line and to a second proximal portion along a second fold line, the first fold line being spaced apart from the second fold line, each of the first proximal portion and the second proximal portion are foldably connected to the bottom panel;

forming at least a portion of an interior of the carton by folding the plurality of panels relative to one another; and positioning the retention tab for engaging at least a bottom portion of at least one article of the plurality of articles, the positioning the retention tab comprising positioning the distal portion of the retention tab to be generally spaced apart from the bottom panel so that each of the first proximal portion and the second proximal portion extends from the bottom panel to the distal portion and so that the retention tab is foldably connected to at least the bottom panel adjacent an opening at least in the bottom panel, wherein the second proximal portion is foldably connected to the bottom panel along a third fold line, and the positioning the retention tab further comprises folding the first proximal portion along the first fold line and folding the second proximal portion along the second fold line and the third fold line so that an edge of the distal portion extends between the first fold line and the second fold line, and a respective edge of each of the first proximal portion, second proximal portion and bottom panel extends between the second fold line and the third fold line.

34. The method of claim 30, wherein the plurality of panels further comprises a side panel foldably connected to the bottom panel along a fourth fold line, the forming at least a portion of the interior of the carton comprises folding the bottom panel relative to the side panel along the fourth fold line, and the opening extends into the side panel, interrupting the fourth fold line after the positioning the retention tab.

35. The method of claim 30, wherein the bottom panel is a first bottom panel, the retention tab is a first retention tab, the plurality of panels further comprises a second bottom panel, the carrier further comprises a second retention tab foldably connected to the second bottom panel, and the method further comprises positioning the first bottom panel and the second bottom panel in an at least partially overlapping relationship with one another, and positioning the second retention tab for engaging at least a bottom portion of a different article of the plurality of articles.

36. The method of claim 30, further comprising obtaining an article of the plurality of articles, the bottom portion of the article comprising a dome feature and an inner rim extending generally downwardly from the dome feature, wherein the positioning the distal portion of the retention tab comprises positioning a distal edge of the distal portion to engage the inner rim.

* * * * *